US005970519A

United States Patent [19]

Weber

[11] Patent Number: 5,970,519

[45] Date of Patent: Oct. 26, 1999

[54] AIR COOLING GARMENT FOR MEDICAL PERSONNEL

[76] Inventor: Stanley Weber, 1987 Lake Marshall Dr., Gibsonia, Pa. 15044

[21] Appl. No.: 09/027,713

[22] Filed: Feb. 20, 1998

[51] Int. Cl.[6] ..... A41D 13/00

[52] U.S. Cl. ..... 2/81; 2/102; 2/458; 2/459; 2/DIG. 1

[58] Field of Search ..... 2/69, 81, 102, 2/DIG. 1, DIG. 3, 97, 458, 459, 456; 62/259.3

[56] References Cited

U.S. PATENT DOCUMENTS

| | | | |
|---|---|---|---|
| 2,540,547 | 2/1951 | Rodert | 2/81 |
| 2,715,266 | 8/1955 | Weiner | 2/DIG. 1 |
| 3,049,896 | 8/1962 | Webb | 62/384 |
| 3,292,179 | 12/1966 | Iacono, Jr. et al. | 2/81 |
| 3,468,299 | 9/1969 | D'Amato | 2/81 |
| 4,194,247 | 3/1980 | Melander | 2/DIG. 3 |
| 4,914,752 | 4/1990 | Hinson et al. | 2/81 |
| 5,243,706 | 9/1993 | Frim et al. | 2/DIG. 1 |
| 5,255,390 | 10/1993 | Gross et al. | 2/DIG. 1 |
| 5,421,326 | 6/1995 | Rankin et al. | 2/69 |
| 5,515,543 | 5/1996 | Gioello | 2/DIG. 1 |
| 5,564,124 | 10/1996 | Elsherif et al. | 2/69 |

*Primary Examiner*—Amy Vanatta
*Attorney, Agent, or Firm*—James Ray & Associates

[57] ABSTRACT

A simple, lightweight cooling garment is provided for medical personnel working at intense medical tasks in warm environments (e.g. lead aprons and sterile gowns). The garment comprises an outer, air impermeable layer of material of minimal weight and bulk and an inner layer of air permeable material of minimal weight and bulk. The layers are secured together in a manner that allows air to flow between such layers and through the inner air, permeable layer to the body of the individual wearing the garment. In addition, means is provided for connecting the garment to a source of air flow containing relatively dry air for direction between the layers of the garment to the body of the individual wearing the garment.

5 Claims, 3 Drawing Sheets

AIR COOLING GARMENT FOR MEDICAL PERSONNEL

FIELD OF THE INVENTION

Figure 2:
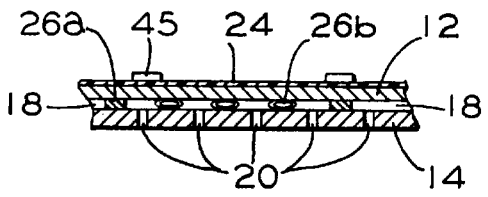

The present invention relates generally to a garment for cooling an individual and, more particularly, to a thin, lightweight and comfortable garment comprised of a minimum number of plies that can be worn by medical personnel working in warm environments (e.g. under lead aprons and impermeable sterile gowns) under stressful conditions over extended periods of time. Under such conditions, medical personnel experience excessive perspiration such that they become fatigued and unduly uncomfortable to the extent that their physical and intellectual performance can suffer.

Medical personnel such as radiologists, cardiologists, surgeons, anesthesiologists and ancillary support staff must often work for long periods of time while wearing heavy lead aprons located under gowns that are impermeable to microorganisms to provide, respectively, radiation protection and sterile conditions. At the same time, hats, surgical masks and waterproof shoe coverings must, also, sometimes be worn. Because of perspiration, such personnel become uncomfortably hot and wet. Depending upon the length and intensity of a given procedure, a person can become saturated with perspiration. The situation is exacerbated by the need to minimize patient morbidity by keeping patients warm while undergoing medical procedures, such as surgery. The most common way to keep patients warm is to increase ambient room temperature.

Discomfort and fatigue can lead to heat stress, possible dehydration, decrease in physical and intellectual performance, additional radiation exposure due to worker reluctance to wear adequate shielding, longer duration of procedures and reluctance to provide a room temperature that is optimal for minimizing patient discomfort.

Presently available means for individual cooling are often heavy and cumbersome. Such means include closed-loop liquid circulation systems or heat absorbing chemical packs placed in the clothing and against the body of the user. Such systems do not remove the moisture (perspiration) on the surface of the person's body, thereby leaving the wearer wet and uncomfortable. Closed-loop liquid circulation systems, in addition, require pumps, cooling devices, such as ice containing reservoirs, and tubing that conduct cool liquid to a garment worn by the user and return the liquid to the cooling devices. This type of equipment is, in addition, heavy and cumbersome.

Another presently available cooling arrangement includes a stationary, immobile air compressor connected to a bladder located in or on a garment. The compressor provides cool air that is directed to the bladder and the bladder directs the air to the body of the user. Mobility of the user is restricted by an umbilical tube connecting the bladder to the fixed compressor. Compressors, in addition, require regular maintenance.

U.S. Pat. No. 5,243,706 to Frim et al. discloses a relatively thick vest for controlling the heat of an individual working in a hot environment such as found in military aircrafts and motorized tanks operating in desert areas. The vest uses a substantial number of layers or plies of porous material. The porous material provides multiple spaces or manifolds for distributing air in the layers and eventually to the body of the individual. The patent disclosure states that other cooling fluids can be used such as vapors of liquid nitrogen or other cold compressed gases.

SUMMARY OF THE INVENTION

The present invention is directed to a simple, preferably two-ply, inexpensive, minimal weight and non-bulky garment provided with means for connecting to a source of relatively dry, room temperature air. The garment is easily made to the size of an individual person such that the garment is comfortable and, being light-weight, does not add significantly to the weight of other clothes and garments worn by the individual. Such other garments include lead aprons etc. Garment bulk in the present invention is reduced to negligible terms by using a minimum number of thin layers of material.

The plies of the garment can consist of only an outer air impermeable layer and an inner layer of air permeable material. Dry air is directed between the two layers and to the body of an individual wearing the garment through the inner air permeable layer. The impermeable nature of the outer layer prevents escape of air through the outer layer. The air flow to the body of the individual removes moisture and perspiration from the body of the individual such that he is made more comfortable when working under high stress conditions over extended periods of time in warm environments. Removal of body moisture and perspiration from the individual, as well as cooling is effected by the flow of air over the body and heat is also removed from the individual by the very effective latent-heat-of-evaporation phenomenon that occurs on the skin of the individual when relatively dry air contacts the skin.

Air flow to the garment can be provided by a small portable fan or blower, which can be self-contained and battery or house current operated such that it can be worn by the user of the garment, or the garment can be pneumatically connected to a small movable blower unit mounted on swivel wheels that will follow the user as he or she moves about the room in performing his or her tasks.

In place of the blower, a portable cylinder or canister of dry air under pressure can also be used and can be, also, self-contained such that it can be worn by the user or placed on a movable staid with swivel wheels. Such a cylinder or canister can be provided with an adjustable nozzle that permits an appropriate volume and velocity of air flow to and through the garment to the user to remove heat and perspiration from the individual in the manner described above.

OBJECTIVES OF THE INVENTION

It is, therefore, an objective of the invention to provide a simple, inexpensive, light-weight, extremely low bulk garment for personnel working in high stress environments over long periods of time, the garment providing a flow of relatively dry air to the body of the individual that is effective in removing moisture and heat from the individual.

Another objective of the invention is to supply such dry air to the garment and to the individual wearing the garment from a room temperature, ambient source that is transportable.

A further objective of the invention is to provide such a garment in a disposable manner for convenience and hygiene purposes or, alternatively, a garment that is washable and, therefore, reusable for a low cost per each use thereof.

THE DRAWINGS

Figure 1:
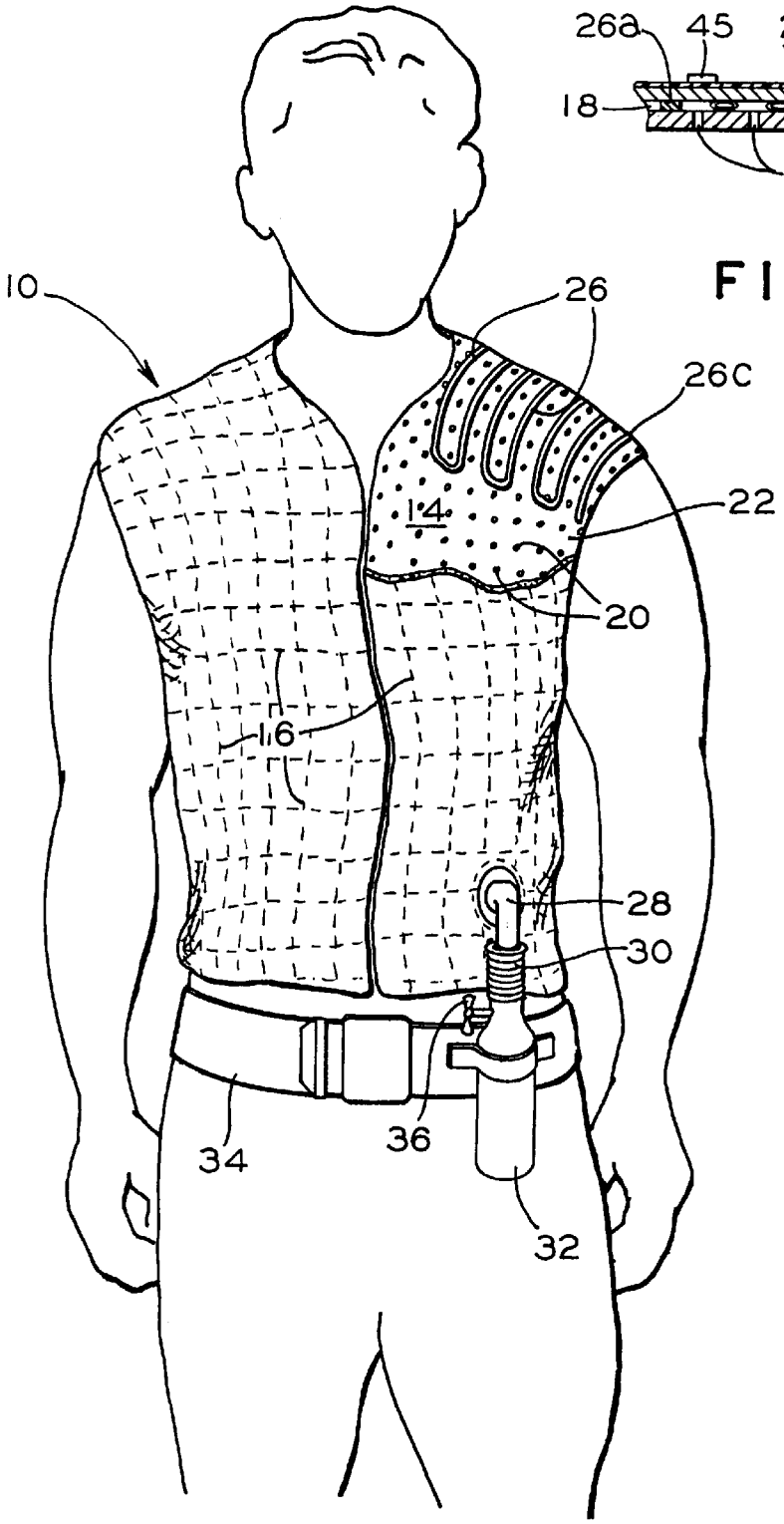
Figure 3:
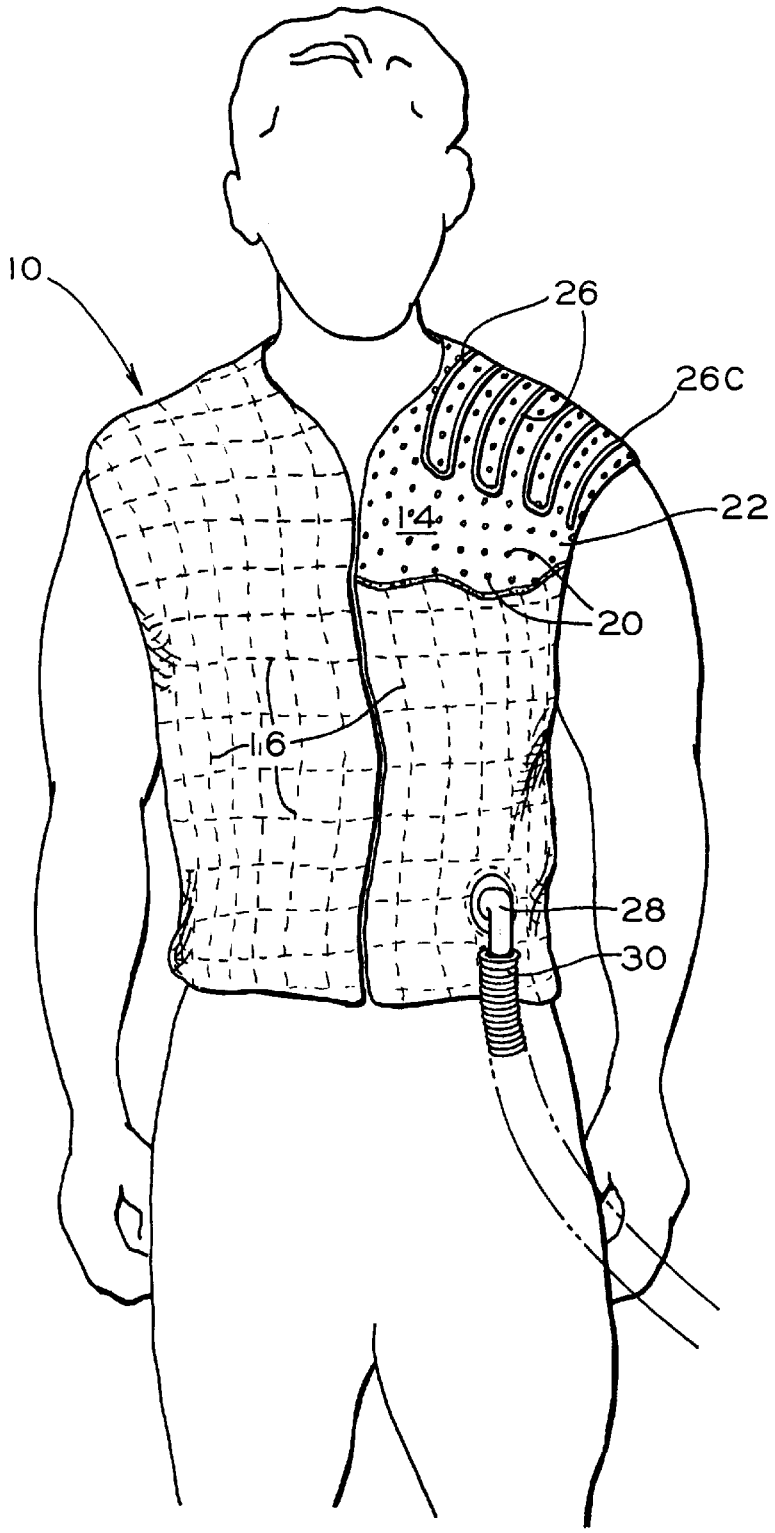
Figure 4:
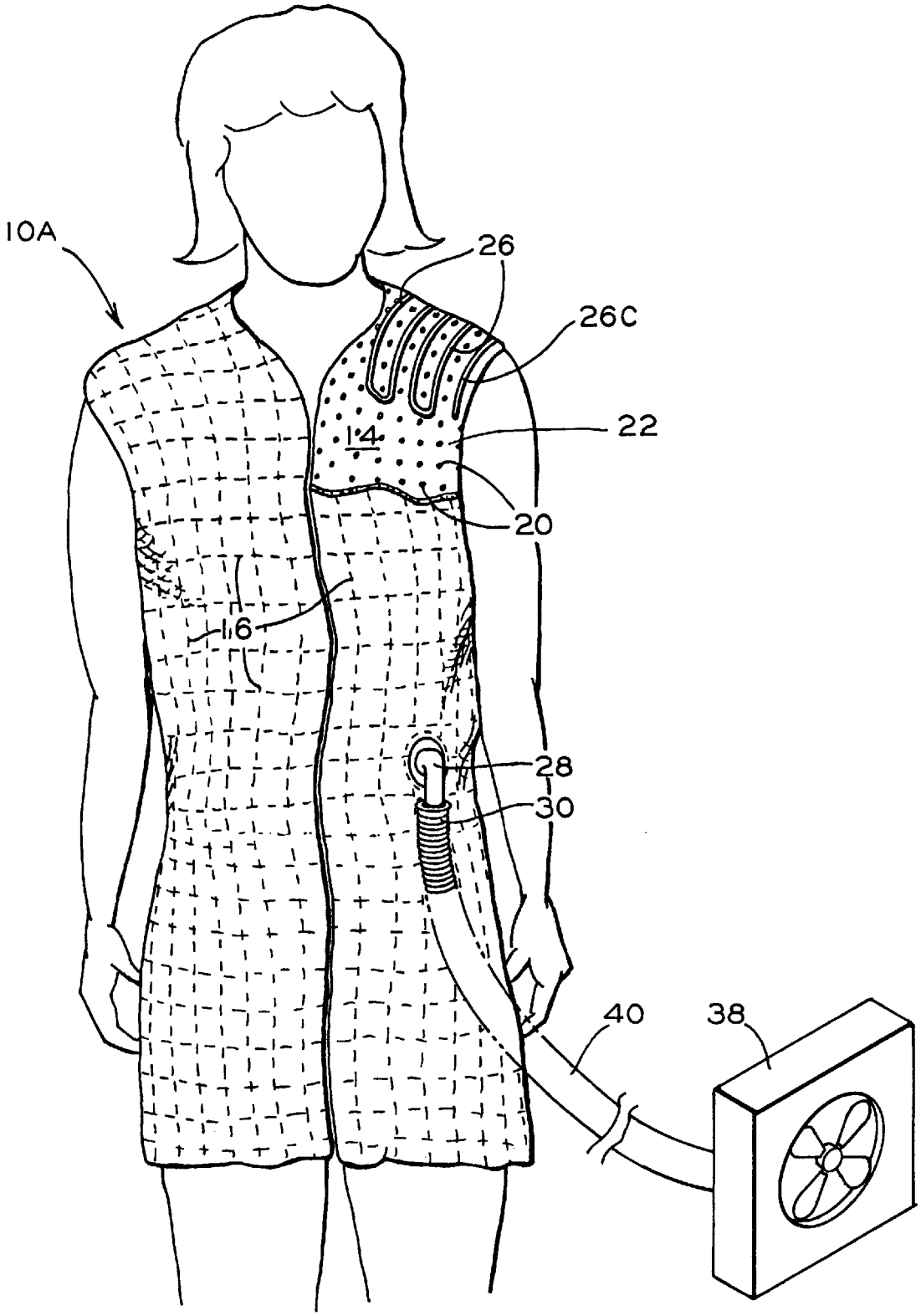

The invention, along with its objectives and advantages, will be better understood from consideration of the following detailed description and the accompanying drawings in which:

FIG. 1 is a front elevation view of a garment of the invention pneumatically connected to a cylinder or canister containing dry, room temperature air under pressure, FIG. 2 shows two layers or plies of material of the garment of FIG. 1 in partial section, FIG. 3 is a front elevation view of the garment of the invention pneumatically connected to a tube for supplying dry air to the garment, and FIG. 4 is a front elevation view of a garment of the invention having a length greater than that depicted in FIG. 1 and 3, and pneumatically connected to a movable blower device.

PREFERRED EMBODIMENTS OF THE INVENTION

Referring now to FIG. 1 of the drawings, a vest 10 of the invention is shown on the upper torso of an individual. The vest is preferably formed of two thin, outer and inner layers of material 12 and 14 (FIG. 2) stitched or otherwise suitably secured together at multiple locations 16 (FIGS. 1, 3 and 4) to prevent substantial separation of layers 12 and 14 by the flow of air under pressure to a space 18 between the layers (FIG. 2). The stitching or securing 16 is of the type that permits the flow of air through the stitching such that air flows throughout substantially the entire area of garment 10 to the body of the individual wearer of the garment.

Air flows to the body of the wearer through inner layer 14, which layer is porous and permeable to such air flow. In FIG. 2, layer 14 is shown with spaced pores or perforations 20 for conducting and directing air to the body of the wearer. Such pores are also shown in an area 22 in FIGS. 1, 3 and 4 that is broken away to reveal the pores in layer 14. However, the material of layer 14 can be such that the entire area of the layer is essentially minutely porous in a manner that allows sufficient and efficient air flow therethrough. If spaced, discrete pores are used that can be provided in a number of appropriate ways.

Outer layer 12 is impermeable to the flow of air so that all air directed to the garment and into any space 18 between layers 12 and 14 is conducted to the body of the user and to the bare skin of the user if he or she has no clothing beneath garment 10.

In FIG. 2, outer layer 12 is shown provided with an outer plastic, non-porous coating 24 to render layer 12 impermeable, though other types of impermeable materials can be used for the outer layer. This includes both disposable (single patient) and washable, reusable materials.

In all cases, it is desirable to use thin, lightweight, form-fitting and non-bulky materials for layers 12 and 14 so that garment 10 does not add substantially to the weight and bulk of clothing and other necessary items and accessories worn by personnel performing intense clinical and medical tasks. Individuals working with and in the vicinity of x-ray equipment should wear lead aprons. Over such aprons, if the individuals are engaged in tasks that may subject them to infectious diseases, gowns made of germ impermeable material are worn. With all this, there are, in addition, surgical caps and masks and shoe coverings that are often required. Thus, the need is to keep any additional clothing worn by such personnel as light and as comfortable as possible.

In FIGS. 1, 3 and 4 of the drawings, the shoulder areas of garment 10 are shown provided with spacing means 26 that maintain outer and inner layers 12 and 14 in a spaced apart manner, particularly when encountering the weight of a lead apron. This ensures air flow between front and rear panels of the garment via the shoulder areas, and air flow to the shoulders of the individual. Such spacing means can be simple, small, narrow, solid pieces 26*a* of lightweight material (FIG. 2) located between layers 12 and 14 at spaced apart locations in the shoulders of the garment and extending across such shoulders to front and rear panels, as shown.

Spacing means 26 can also be flexible tubing 26*b*, also shown in FIG. 2, located between layers 12 and 14. Such tubing is shown extending across the shoulders of the person wearing the garment in FIGS. 1, 3 and 4 and has sufficient capability to support the weight of a lead apron such that the shoulder areas of the garment remain open to the flow of air. If the tubes are open ended, as indicated by tube 26*c* in FIGS. 1, 3 and 4, the tubes can themselves conduct air flow across the shoulders of the individual.

Supply of air to garment 10 can be effected by a hose connection 28 secured to the garment such that the connection opens into space 18 (FIG. 2) between layers 12 and 14 of the garment, while the other end of the hose is adapted to pneumatically connect to a flexible hose 30. Hose 30 is adapted to connect to a supply of dry air. In FIG. 1 of the drawings, such supply is a portable canister or cylinder 32 shown mounted on a belt 34 of the wearer of garment 10 and containing the supply of dry air under suitable pressure. A hand operated adjustable valve 36 can be provided at the upper end of canister 32 to provide an air flow rate to garment 10 that is suitable and comfortable (tailored) to the individual user.

Cylinder 32 may also be larger than that shown in FIG. 1, i.e., the cylinder may comprise a tank of compressed air located on a floor mounted stand (not shown) with swivel wheels. In this manner, the tank can follow the individual connected to the tank by a suitable hose.

In using a pressurized source of dry air, the air exiting the source, e.g. cylinder 32 and into garment 10 expands and is thereby cooler than room temperature to provide additional cooling for the individual. This is particularly important if the room in which the individual is working is excessively warm.

FIG. 4 of the drawings shows a garment 10A of the invention pneumatically connected to a portable blower device 38 by a hose connection 28, a flexible hose portion 30 and an elongated, flexible hose 40 extending to the blower device. The blower device can be floor mounted or located on a stand with swivel wheels (not shown) so that it follows the wearer of garment 10 or 10A as he or she moves about a room or, if the blower is small and sufficiently light in weight, it can be mounted on the wearer. Blower device 38 includes a motor (not visible in FIG. 4) that can be powered by AC house current using a flexible cable of suitable length, or the blower can be powered by a small, lightweight battery.

Garments 10 and 10A and their associated sources of air, as thus far described, function in the following manner. An individual preparing for duty in an operating or other room where a medical task or tasks may be long in duration and strenuous puts on and secures the garment using suitable fasteners such as buttons, hooks and/or zippers (not shown), or the garment 10 or 10A can be secured in an outer garment, such as a lead apron, by appropriate fasteners 45 (FIG. 2) suitably provided on the outer surface of outer layer 12 of garment 10 or 10A, or on the inner surface of the outer garment. If the fasteners are strips of VELCRO®, for example, they can be provided on both garments.

The individual now connects an air supply device (32 or 38) to hose connection 28 so that the garment is ready to be supplied with a flow of air. It is assumed that the air in the room in which the individual will be working is relatively dry (as is the case in hospitals) if a blower device is used, as such a device will be drawing in room air and directing it to garment 10 or 10A. If a canister 32 is used, the temperature of the air contained therein will be at room temperature but it may be drier than that found in the room.

The individual now turns on blower 38 or operates valve 36 to begin supplying air to garment 10 or 10A. Air enters space 18 between the layers of the garment and flows through the inner, air permeable layer 14 (through pores 20 if discrete pores are used) to the body of the wearer. The air flow has a velocity that is effective in carrying away moisture (perspiration) from body surfaces of the individual as the air exits at the waist, neck, arms and legs (FIG. 4) of wearer.

In addition, the wearer is cooled by the latent heat of evaporation that takes place when body skin receives relatively dry air, such a phenomenon being very effective in removing heat from an individual.

When the medical task is completed, the wearer simply turns off the blower or canister, disconnects hose connection 28 and removes the garment. The task may have been long and strenuous, or stressful, but the individual wearing garment 10 or 10A with air flowing therethrough will not be thoroughly wet and uncomfortable.

If garment 10 or 10A is made of disposable materials, after use, it is deposited in an appropriate container or location for disposal. If the garment is made of washable or cleanable materials, it can be dispatched for washing or cleaning after use thereof.

While the presently preferred embodiments for carrying out the instant invention has been set forth in detail above, those persons skilled in performing stressful medical and clinical tasks to which this invention pertains will recognize various alternative ways of practicing the invention without departing from the spirit and scope of the claims appended hereto.

What is claimed is:

1. A simple, minimum weight and thickness cooling garment for medical personnel working at medical tasks in warm environments, comprising:

an outer, air impermeable layer of material of minimal thickness, an inner layer of air permeable material of minimal thickness, means securing said layers directly together with no intermediate material or structures located between said layers to maintain the minimum weight and thickness characteristics of the garment, but in a manner that allows air to flow between said layers and through the inner air permeable layer to a body of an individual wearing the garment and freely exit from between the wearer and the garment without use of control exit ports in the garment, and means for connecting the garment to a source of airflow containing a minimum amount of moisture for direction between said layers and to the body of the individual wearing the garment.

2. The simple, minimum weight and thickness garment of claim 1 wherein the garment has shoulder portions provided with discrete spacer means that separate the inner and outer layers of material in a manner that ensures airflow between said layers in a region of said shoulder portions when the wearer of the garment is wearing a heavy garment over the minimum weight garment and which rests on the shoulder portions of said garment.

3. The simple, mimimum weight and thickness garment of claim 2 wherein the descrete spacer means that separate the inner and outer layers of the shoulder portions includes spacers located between said layers at spaced locations over a breadth of the shoulder portions.

4. The simple, minimum weight and thickness garment of claim 3 wherein the discrete spacer means that separate the inner and outer layers of the shoulder portions includes spaced apart, flexible tubing connected in fluid communication with front and rear portions of the garment.

5. The simple, minimum weight and thickness garment of claim 3 wherein the heavy garment is an x-ray impervious lead apron.

* * * * *

UNITED STATES PATENT AND TRADEMARK OFFICE

CERTIFICATE OF CORRECTION

PATENT NO. : 5,970,519
DATED : October 26, 1999
INVENTOR(S) : Stanley Weber

It is certified that error appears in the above-identified patent and that said Letters Patent is hereby corrected as shown below:

Column 1, line 42, after "reservoirs" please delete ",".
Column 2, line 7, after "aprons" please insert --,--;
column 2, line 21, after "cooling" please insert --,--;
column 2, line 36, after "movable" please delete "staid" and insert --stand--.
Column 3, line 7, after "in" please delete "Fig." and insert --Figs.--;
Column 3, line 65, after "areas" please delete the ",".
Column 4, line 32, after "10" please insert --,--.
Column 5, line 13, before "wearer" please insert --the--;
Column 6, line 27, after "the" (first occurrence) please delete "descrete" and insert --discrete--.

Signed and Sealed this

Ninth Day of May, 2000

*Attest:*

Q. TODD DICKINSON

*Attesting Officer*

*Director of Patents and Trademarks*